US008424328B2

(12) United States Patent
Lifson et al.

(10) Patent No.: US 8,424,328 B2
(45) Date of Patent: Apr. 23, 2013

(54) SUCTION VALVE PULSE WIDTH MODULATION CONTROL BASED ON EVAPORATOR OR CONDENSER PRESSURE

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 834 days.

(21) Appl. No.: 12/514,380

(22) PCT Filed: Nov. 30, 2005

(86) PCT No.: PCT/US2005/047704

§ 371 (c)(1), (2), (4) Date: Nov. 10, 2009

(87) PCT Pub. No.: WO2009/058106

PCT Pub. Date: May 7, 2009

(65) Prior Publication Data

US 2010/0058799 A1 Mar. 11, 2010

(51) Int. Cl.
*F25B 49/00* (2006.01)
*G05D 7/00* (2006.01)

(52) U.S. Cl.
USPC ..... 62/228.3; 62/228.1; 700/282

(58) Field of Classification Search ..... 62/498, 62/228.1, 228.3, 228.5; 700/282
See application file for complete search history.

(56) References Cited

U.S. PATENT DOCUMENTS

| | | | | |
|---|---|---|---|---|
| 4,838,037 | A * | 6/1989 | Wood | 62/225 |
| 6,047,556 | A | 4/2000 | Lifson | |
| 6,047,557 | A * | 4/2000 | Pham et al. | 62/228.5 |
| 6,092,380 | A | 7/2000 | Kachur | |
| 6,206,652 | B1 | 3/2001 | Caillat | |
| 6,886,355 | B2 * | 5/2005 | Obrist et al. | 62/196.3 |
| 2003/0145614 | A1 | 8/2003 | Tanaka | |
| 2004/0007003 | A1 | 1/2004 | Healy et al. | |
| 2005/0012740 | A1 | 1/2005 | Takahashi et al. | |
| 2005/0120740 | A1 | 6/2005 | Enomoto | |

FOREIGN PATENT DOCUMENTS

| | | |
|---|---|---|
| JP | 5231723 | 9/1993 |
| WO | 9917066 | 4/1999 |
| WO | 0242101 | 5/2002 |

OTHER PUBLICATIONS

International Search Report dated Apr. 17, 2009.
European Search Report dated Jan. 31, 2011.

* cited by examiner

*Primary Examiner* — Chen Wen Jiang
(74) *Attorney, Agent, or Firm* — Carlson, Gaskey & Olds, PC

(57) ABSTRACT

A refrigerant system is provided with a suction pulse width modulation valve, and a pulse width modulation control for controlling this valve. System pressures, such as the pressure on the evaporator and the condenser are monitored. The measured system pressures are maintained within a band of acceptable lower and upper limits. As the pulse width modulation control cycles the valve, the refrigerant pressures in the evaporator and the condenser tend to fluctuate. The control ensures those fluctuations are within the limits by controlling the duty cycle of the valve.

18 Claims, 1 Drawing Sheet

SUCTION VALVE PULSE WIDTH MODULATION CONTROL BASED ON EVAPORATOR OR CONDENSER PRESSURE

BACKGROUND OF THE INVENTION

This application relates to a pulse width modulation control for a suction pulse width modulation valve that allows for continuous or precise stepwise capacity to be provided by a refrigerant system, and wherein system pressures are monitored to determine an optimum duty cycle for the pulse width modulation.

Refrigerant systems are utilized in many applications such as to condition an environment. Air conditioners and heat pumps are used to cool and/or heat the air entering an environment. The cooling or heating load on the environment may change with ambient conditions, and as the temperature and/or humidity levels demanded by an occupant of the environment vary. Obviously, the refrigerant system operation and control have to adequately reflect these changes to maintain stable temperature and humidity conditions within the environment.

One method that is known in the prior art to assist in the adjustment of capacity from a refrigerant system is the use of a pulse width modulation control. It is known in the prior art to apply a pulse width modulation control to rapidly cycle a valve for controlling the flow of refrigerant through the refrigerant system, to in turn adjust capacity. By limiting the amount of refrigerant flow passing through the system, the capacity can be lowered below a full capacity of system operation.

One challenge raised by the prior art use of pulse width modulation controls is that while this technique does provide good control over capacity, the system pressures across the refrigerant system can have undesirably large fluctuations between the on/off positions of the suction pulse width modulation valve. If the valve is left open or closed for long periods of time, the pressures at the condenser and evaporator, for example, can fluctuate greatly. Such pressure fluctuations are undesirable and may make it difficult to control the operation of the expansion valve, it may become harder to maintain a constant temperature within the environment to be cooled, and the overall system operation may become less efficient.

On the other hand, if the valve is cycled too frequently to minimize the pressure fluctuations, there are additional losses associated with a system transition from the valve being open to the valve being in a closed position. Further, the chance of valve failure increases due to the extensive cycling.

In another proposed control for an HVAC system, a pulse width modulation control is provided for the pulse width modulation of scroll elements by separating the elements and bringing them back into contact with each other in a pulse width modulated manner. This control will monitor pressures or temperatures on the suction (low pressure) side, and adjust the pulse width modulation duty cycle. However, this disclosed control does not specifically seek to minimize fluctuations, does not control a suction pulse width modulation valve, and also does not monitor conditions on the discharge (high pressure) side of the system.

SUMMARY OF THE INVENTION

In a disclosed embodiment of this invention, a pulse width modulation control is provided for selectively varying the amount of refrigerant flow passing from an evaporator downstream to the compressor. By controlling the amount of refrigerant flow passing through a suction pulse width modulation valve, the capacity provided by the refrigerant system can be varied. The control monitors signals indicative of at least one system pressure, and ensures that the pressure does not fluctuate outside of specified limits. The duty cycle of the suction pulse width modulation valve is selected to ensure that the pressure fluctuations stay within those limits. In a disclosed embodiment, the system pressure is monitored either at the condenser or the evaporator, or both. Should the pressure fluctuations approach the limits, then the suction pulse width modulation valve cycling rate is adjusted to stay within the specified limits. On the other hand, as long as the pressure fluctuations are within the limits, no adjustment to the valve cycling rate may be required. One of the most effective methods for reduction of pressure fluctuation would be to increase the cycling rate of the valve. However, other parameters, such as, for example, the opening and closing time of the valve can be varied to achieve the desired result.

The cycling rate can be adjusted based upon operating conditions, how tight the parameters of temperature and humidity within an environment to be cooled are maintained, reliability limitations on the solenoid valve, efficiency goals, system thermal inertia, stability considerations, etc. Alternatively, some adaptive control can be utilized wherein the control "learns" how variations in the duty cycle will result in changes in the sensed pressure. A worker of ordinary skill in the art would recognize how to provide such a control.

These and other features of the present invention can be best understood from the following specification and drawings, the following of which is a brief description.

DETAILED DESCRIPTION OF THE PREFERRED EMBODIMENTS

Figure 1:
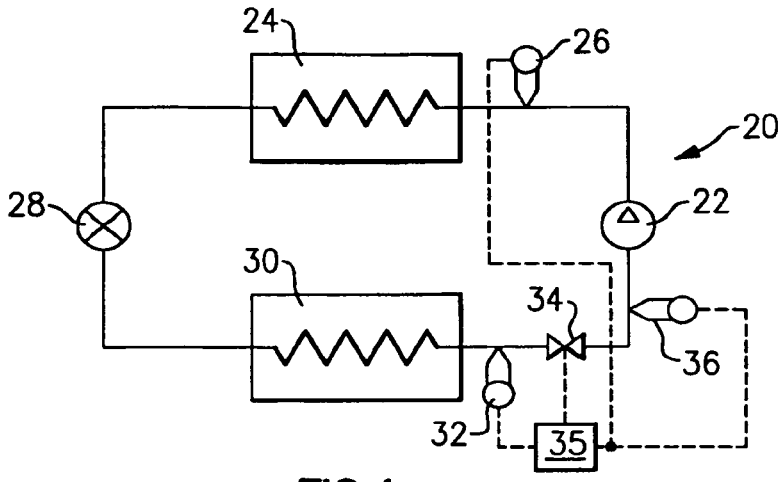
FIG. 1 shows a schematic of a refrigerant system incorporating the present invention.

A refrigerant system 20 is illustrated in FIG. 1 having a compressor 22 compressing a refrigerant and delivering it downstream to a condenser 24. A pressure sensor 26 senses the pressure near or at the condenser 24. The refrigerant passes downstream to an expansion valve 28, and then to an evaporator 30. A pressure sensor 32 senses the pressure of the refrigerant near or at the evaporator 30. A suction pulse width modulation valve 34 is positioned downstream of the evaporator 30. A control 35 controls the opening of the suction pulse width modulation valve. A pressure sensor 36 senses the pressure of the suction line leading from the suction pulse width modulation valve 34 back to the compressor 22.

The pressure associated with the condenser 24 (sensed by the sensor 26) and with the evaporator 30 (sensed by the sensor 32) are both transmitted to the control 35. The control 35 is programmed to achieve benefits as set forth below.

Figure 2:
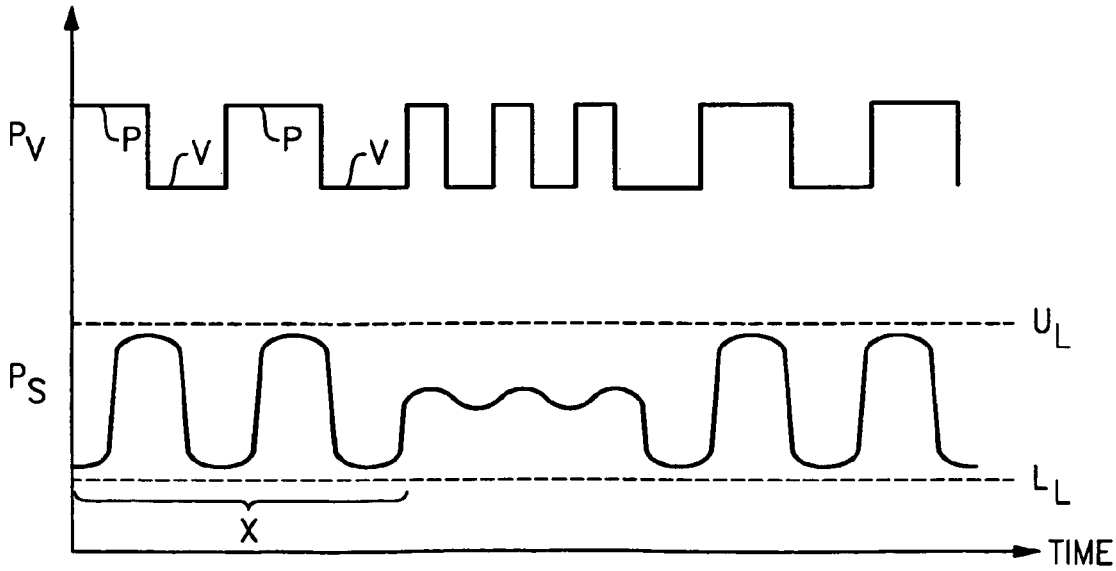
FIG. 2 shows is a time versus pressure chart of a pulse width modulation control, including system pressure over time.

As shown in FIG. 2, the opening of the suction pulse width modulation valve 34 is controlled with pulse width modulation. The pulse width modulation control will result in peaks P and valleys V as the suction pulse width modulation valve 34 is cycled open and closed. In a disclosed embodiment, the suction pulse width modulation valve 34 is a solenoid valve that is capable of rapid cycling. The present invention changes the duty cycle, or time over which the peaks P and valleys V exist.

FIG. 2 also shows a system pressure that may be the pressure monitored by sensor 26, or the pressure sensor 32. In a disclosed embodiment, both pressures may be monitored and thus the following disclosed control would be used for both. An upper limit $U_L$ and a lower limit $L_L$ are set. The pressures are maintained within the boundaries set by those two limits. The boundaries would likely be different on the high side (sensor 26) than on the low side (sensor 32). Thus, the control 35 monitors the pressures and ensures the pressures are between the limits. As long as the pressures are between the limits, the valve is cycled at a relatively slow rate, while still achieving the desired capacity. As the pressure fluctuations approach a limit, the suction pulse width modulation valve 34 is cycled at a more rapid rate, which should minimize the pressure fluctuations.

As can be appreciated from FIG. 2, in a region X on a system pressure graph one of the pressures is approaching limits $U_L$ and $L_L$. A duty cycle, or the time over which the peaks P and valleys V have existed as the valve is opened and closed, is relatively long. However, when the control 35 senses that the pressure fluctuations are becoming unduly great (as illustrated over region X), the duty cycle is reduced such that the peaks and valleys are maintained over much shorter time periods. By lowering the period over which the valve is open and closed, the pressure fluctuations become lower, as is illustrated downstream of the region X. The present invention thus achieves suction pulse width modulation valve control with pulse width modulation, while addressing the pressure fluctuation concerns set forth above. Further, the present invention also monitors a high side pressure, or a pressure of the refrigerant at a location where it is compressed. The prior art has typically only looked at suction pressures, and thus has not provided the control capability of the present invention.

In another feature, the control can be an adaptive control that "remembers" changes in the duty cycle, which have been provided in the past, and the resultant changes in system pressures. Thus, the control can "learn" to better control the pressure fluctuations, and to result in system pressures that are at desired levels. The control also can hunt for the best way to cycle the pulse width modulated valve by trying different cycling rates to establish which one would produce the best results within the imposed constraints, for example, on the maximum cycling rate of the valve.

Further, it has to be pointed out that the pulse width modulated suction valve may have open and closed states corresponding to not necessarily fully open and fully closed positions, that provides additional flexibility in system control and operation.

Pulse width modulation controls are known, and valves operated by the pulse width modulation signal are known. The present invention utilizes this known technology in a unique manner to achieve goals and benefits as set forth above.

Although a preferred embodiment of this invention has been disclosed, a worker of ordinary skill in this art would recognize that certain modifications would come within the scope of this invention. For that reason, the following claims should be studied to determine the true scope and content of this invention.

We claim:

1. A refrigerant system comprising:

a compressor, a condenser downstream of said compressor, an expansion device downstream of said condenser and an evaporator downstream of said expansion device;

a suction pulse width modulation valve positioned between said evaporator and said compressor;

a control for selectively operating said suction pulse width modulation valve to deliver refrigerant to said compressor, said control being operable to utilize a pulse width modulation signal to operate the suction pulse width modulation valve, and a duty cycle of said pulse width modulation signal being controlled to control fluctuations in a sensed system pressure; and an upper limit and a lower limit are set for said system pressure, and a control monitors said system pressure to ensure it is maintained within said upper and lower limits. and said control adjusting said duty cycle of said suction pulse width modulation valve to ensure said system pressure is maintained between said upper and lower limits.

2. The refrigerant system as set forth in claim 1, wherein said system pressure is associated with said condenser.

3. The refrigerant system as set forth in claim 2, wherein said system pressure is also associated with said evaporator.

4. The refrigerant system as set forth in claim 1, wherein said system pressure is associated with said evaporator.

5. The refrigerant system as set forth in claim 1, wherein if said system pressure approaches one of said upper and lower limits, said duty cycle is modified such that said valve is maintained open and closed for shorter periods of time.

6. A refrigerant system comprising:

a compressor, a condenser downstream of said compressor, an expansion device downstream of said condenser and an evaporator downstream of said expansion device; and a control for selectively operating a component of said refrigerant system, said control being operable to utilize a pulse width modulation signal to operate the component, and a duty cycle of said pulse width modulation signal being controlled in combination with a sensed system pressure to ensure said sensed system pressure does not fluctuate outside of pre-determined upper and lower limits

7. The refrigerant system as set forth in claim 6, wherein said system pressure is associated with said condenser.

8. The refrigerant system as set forth in claim 6, wherein said system pressure is associated with said evaporator.

9. The refrigerant system as set forth in claim 6, wherein said component is a suction pulse width modulation valve.

10. The refrigerant system as set forth in claim 9, wherein said suction pulse width modulation valve can be opened between fully opened and fully closed positions, and also is movable to intermediate positions.

11. A method of controlling a refrigerant system comprising the steps of:

providing a compressor, a condenser downstream of said compressor, an expansion device downstream of said condenser, an evaporator downstream of said expansion device, and a suction pulse width modulation valve positioned between said evaporator and said compressor; and selectively operating said suction pulse width modulation valve to deliver refrigerant to said compressor, by utilizing pulse width modulation signal to operate the suction pulse width modulation valve, and a duty cycle of said pulse width modulation signal being controlled in combination with a sensed system pressure to ensure said sensed system pressure does not exceed upper and lower limits of fluctuation.

12. The method as set forth in claim 11, wherein if said system pressure approaches one of said limits, said duty cycle is reduced such that said valve is maintained open and closed for shorter periods of time.

13. A refrigerant system comprising:

a compressor, a condenser downstream of said compressor, an expansion device downstream of said condenser and an evaporator downstream of said expansion device;

a control for selectively operating a component of said refrigerant system, said control being operable to utilize a pulse width modulation signal to operate the component, and a duty cycle of said pulse width modulation signal being controlled in combination with a sensed system pressure taken on a high pressure side of the refrigerant system to ensure said sensed system pressure is maintained as desired: and setting an upper limit and a lower limit for said system pressure, and a control monitoring said system pressure to ensure it is maintained within said upper and lower limits and said control adjusting said duty cycle of said suction pulse width modulation valve to ensure said system pressure is maintained between said upper and lower limits.

14. The refrigerant system as set forth in claim 13, wherein said component is a suction pulse width modulation valve.

15. The refrigerant system as set forth in claim 14, wherein said suction pulse width modulation valve can be opened between fully opened and fully closed positions, and also is movable to intermediate positions.

16. The refrigerant system as set forth in claim 13, wherein said system pressure is associated with said condenser.

17. The refrigerant system as set forth in claim 13, wherein said system pressure is associated with said evaporator.

18. The refrigerant system as set forth in claim 13, wherein if said system pressure approaches one of said limits, said duty cycle is reduced such that said valve is maintained open and closed for shorter periods of time.

* * * * *